United States Patent [19]

Hess

[11] 4,053,042

[45] Oct. 11, 1977

[54] ENDLESS RIBBON CARTRIDGE

[75] Inventor: Ernst P. Hess, Castro Valley, Calif.

[73] Assignee: Qume Corporation, Hayward, Calif.

[21] Appl. No.: 687,716

[22] Filed: May 19, 1976

Related U.S. Application Data

[63] Continuation of Ser. No. 530,120, Dec. 6, 1974, abandoned.

[51] Int. Cl.[2] ..... B41J 33/10

[52] U.S. Cl. ..... 197/168; 197/151

[58] Field of Search ..... 35/8 A, 35 C; 40/86; 197/151, 153 R, 168, 170, 172, 159, 1 R, 180; 360/93, 132

[56] References Cited

U.S. PATENT DOCUMENTS

| | | | |
|---|---|---|---|
| 3,075,627 | 1/1963 | Kuckhoff | 197/151 |
| 3,349,887 | 10/1967 | Goff | 197/151 |
| 3,731,781 | 5/1973 | Caudill et al. | 197/151 |
| 3,830,351 | 8/1974 | Cadpotto | 197/151 |
| 3,831,731 | 8/1974 | Mack et al. | 197/151 |
| 3,863,749 | 2/1975 | Perry et al. | 197/151 |

FOREIGN PATENT DOCUMENTS

| | | | |
|---|---|---|---|
| 12,870 of | 1914 | United Kingdom | 197/168 |
| 29,235 of | 1914 | United Kingdom | 197/168 |

*Primary Examiner*—Anton O. Oechsle
*Assistant Examiner*—Vance Y. Hum
*Attorney, Agent, or Firm*—Townsend and Townsend

[57] ABSTRACT

An endless ribbon cartridge for supplying ribbon to an external printing station with relatively uniform tension and including an anti-fouling mechanism to prevent snarling of the ribbon as it re-enters the cartridge. The cartridge comprises a two-piece housing having a cover and a main body portion with separate exit and entrance slots and interior boundary walls partially defining a ribbon chamber having entrance and exit portions. An endless ribbon is partially received within the chamber in random folds, the remainder of the ribbon traversing a looped path from the chamber exit portion through the housing exit slot and the housing entrance slot to the chamber entrance portion. A capstan and pinch roller assembly is provided adjacent the entrance slot to translate the ribbon along the looped path. Tensioning is located at the chamber exit portion, and optional additional tensioning is located at the exit slot, providing a drag force for maintaining the ribbon tension at the external printing station substantially uniform. These tensioning devices are comprised of a simple spring member having a blade portion and an offset central hub, the spring member being mounted in a flexed position. The boundary wall adjacent the exit portion of the chamber is provided with a relieved channel which receives a mating boss depending downwardly from the inner surface of the cartridge cover member in order to limit motion of the exiting ribbon in the direction transverse to the desired translational direction.

11 Claims, 10 Drawing Figures

ENDLESS RIBBON CARTRIDGE

This is a continuation of application Ser. No. 530,120, filed Dec. 6, 1974, now abandoned.

BACKGROUND OF THE INVENTION

This invention relates to cartridges having an endless inked ribbon contained therein and means for translating the ribbon from an exit slot past a print station and through an entrance slot into the interior thereof.

Inked ribbon cartridges are known which supply an endless inked ribbon to a printing station of an associated printing device, e.g. a rotary printer or a typewriter. In typical devices of this type, a large quantity of the ribbon is normally contained within the cartridge in an interior ribbon chamber defined by boundary walls having an entrance protion and an exit portion, with the boundary walls arranged at least partially interior of the side walls of the cartridge. The ribbon is typically arranged within the ribbon chamber in random folds and a loop is formed which extends from the boundary wall exit portion through the cartridge wall exit slot, past the external printing station, through the cartridge wall entrance slot and through the boundary wall entrance portion back into the ribbon chamber. A capstan and pinch roller is customarily provided adjacent the entrance to the ribbon chamber, with the capstan being driven by an external drive mechanism to provide a pulling force for translating the ribbon from the ribbon chamber along the loop path and back into the ribbon chamber. As the ribbon is translated in this manner, the ribbon migrates across the ribbon chamber and the random ribbon folds change shape, with new folds appearing adjacent the boundary wall entrance portion and folds adjacent the boundary wall exit portion disappearing.

In order to maintain the print quality of the characters printed at the external station substantially uniform, the tension of that portion of the inked ribbon located in the printing station must be maintained relatively constant in order to preclude stretching or contracting of this portion of the ribbon. This is typically achieved by providing a tensioning member either exterior of the cartridge, or internally thereof. Interior tensioning mechanisms employed in the past for this purpose include a spring blade member positioned adjacent the exit portion of the boundary walls for biasing the exiting ribbon against an edge surface. In addition, known cartridges have also employed two such spring members for this purpose, one located at the boundary wall exit portion and another located at the cartridge wall exit slot.

In order to function properly, the endless ribbon must be fed back into the ribbon chamber in such a manner that the random folds are free to migrate across the chamber from the boundary wall entrance portion to the boundary wall exit portion without snarling or tangling. Problems have been encountered, however, with known devices using a capstan and pinch roller for drawing the ribbon into the ribbon chamber with fouling of the ribbon usually occurring in the region of the capstan and pinch roller. While attempts have been made to find a solution to this problem, such attempts have not been uniformly satisfactory, since such solutions require the use of additional parts which greatly increase the manufacturing cost of the cartridge. Since an endless inked ribbon cartridge is normally designed as a disposable item, the device should preferably embody a minimum number of working elements in order to maintain the manufacturing costs at a minimum, while at the same time, providing trouble-free operation. To date, efforts to design a low cost endless inked ribbon cartridge meeting the above criteria have not met with wide success.

SUMMARY OF THE INVENTION

The invention comprises an endless inked ribbon cartridge capable of supplying ribbon to an external printing station with relatively uniform tension, which operates without fouling of the ribbon, and which is extremely simple to fabricate, rugged in construction, and highly reliable in performance. In the preferred embodiment, the cartridge comprises a two-piece housing including a cover and a main body portion, the latter having an exit slot, an entrance slot and interior boundary walls for partially defining a ribbon chamber, the chamber having an entrance portion and an exit portion; an endless ribbon partially received within the ribbon chamber in random folds, with the remainder of the ribbon traversing a looped path from chamber exit portion past the housing exit slot, externally of the cartridge to the printing station and back to the housing past the housing entrance slot and the chamber entrance portion back into the ribbon chamber; tensioning means adjacent the chamber exit portion; means for transporting the endless ribbon from the boundary wall exit portion along the looped path and back into the ribbon chamber; and means adjacent the transporting means for preventing fouling or snarling of the reentrant ribbon portion. The ribbon transport means includes a power driven rotatable ribbon capstan having a ribbon gripping surface enclosed between a pair of axially spaced guide flanges, a freely rotatable pinch roller having a ribbon gripping surface, and a pinch roller biasing mechanism for urging the pinch roller against the ribbon capstan to form a ribbon gripping region in which the ribbon is firmly grasped therebetween, the arrangement requiring only a shallow wrap angle. The ribbon capstan is additionally provided with an end shaft which protrudes exteriorly of the cartridge housing to facilitate cartridge installation and initial set up.

The ribbon tensioning means comprises a spring blade having an off-set central hub with a bore received by an upstanding mounting pin extending from the inner surfaces of the bottom walls of the cartridge housing main body portion, the spring blade being flexed with one end biasing the ribbon against an edge of the boundary wall exit portion.

The ribbon anti-fouling means comprises a substantially similar spring blade mounted adjacent the ribbon capstan in a similar flexed attitude, with a chamfered end of the spring blade bearing against the capstan central surface downstream of the ribbon gripping region for stripping ribbon from the capstan surface as the ribbon enters the ribbon chamber. A second ribbon tensioning means substantially identical to that described supra is optionally provided adjacent the cartridge housing exit slot, with one end of the flexed spring blade biasing the ribbon against an edge of a stationary guide.

The boundary wall adjacent the exit portion is provided with a relieved channel extending transversely along the top surface which receives a mating boss depending downwardly from the inner surface of the cover member in order to limit the motion of the exiting ribbon in a direction transverse to the desired translational motion.

In operation, the endless inked ribbon is withdrawn from and returned to the ribbon chamber by the capstan and pinch roller driven by an external associated power source. Exiting ribbon is maintained under relatively constant tension by the action of the spring blade biasing the ribbon against the edge of the boundary wall exit portion. Entering ribbon is deflected away from the surface of the ribbon capstan downstream of the ribbon gripping region by the stripping action provided by the chamfered end of the adjacent spring blade in sliding contact with the capstan ribbon gripping surface. The channel and boss adjacent the boundary wall exit portion limits the motion of the exiting ribbon in a direction transverse to the desired translational movement.

For a fuller understanding of the nature and advantages of the invention, reference should be had to the ensuing detailed description taken in conjunction with the accompanying drawings.

DESCRIPTION OF THE PREFERRED EMBODIMENT

Figure 1:
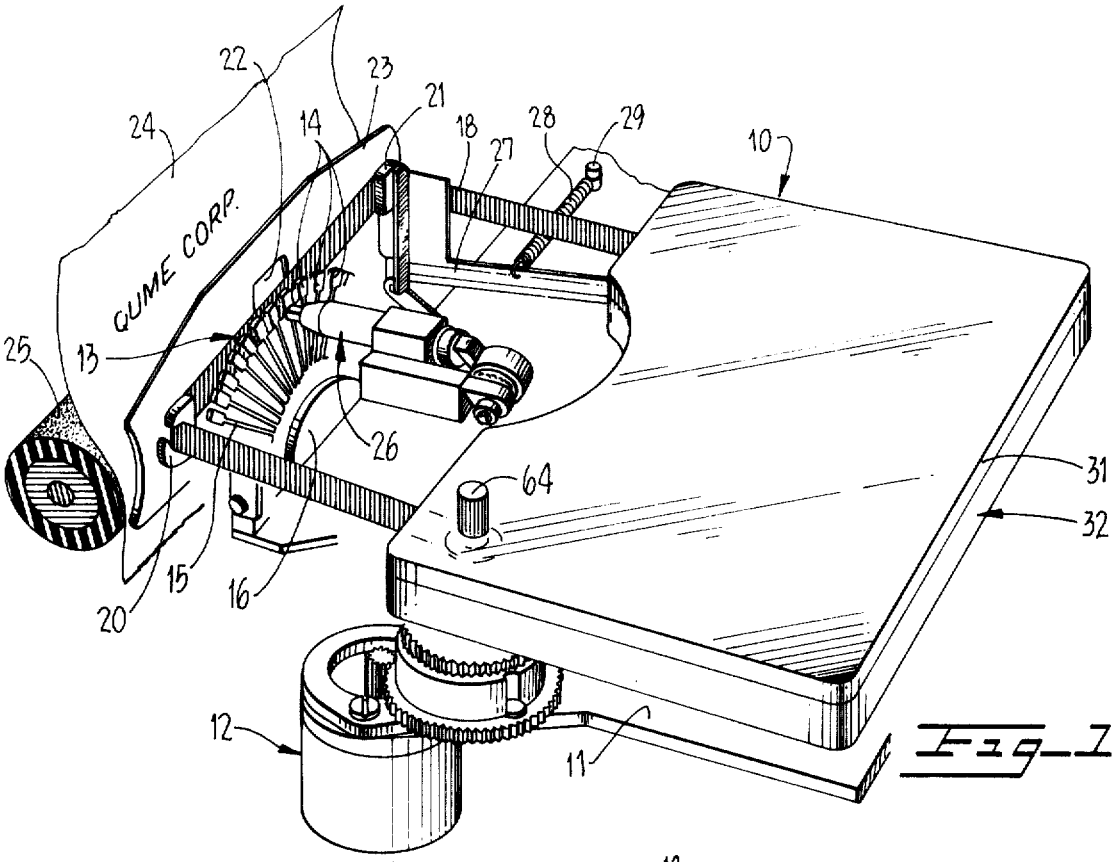
FIG. 1 is a perspective view of the preferred embodiment of the invention.

Turning now to the drawings, FIG. 1 is a perspective view illustrating the preferred embodiment of the invention mounted for operative association with a printing device. As seen in this FIG., an endless inked ribbon cartridge 10 is mounted on a platform 11 provided with a suitable drive mechanism indicated by reference numeral 12. Drive mechanism 12 is preferably an incremental ribbon capstan drive mechanism of the type disclosed and claimed in my co-pending patent application for "CARTRDIGE DRIVE APPARATUS," Ser. No. 448,848, filed Mar. 7, 1974, abandoned in favor of application Ser. No. 604,758 filed Aug. 14, 1975 now U.S. Pat. No. 3,967,790 issued July 6, 1976 the disclosure of which is hereby incorporated by reference. Other suitable compatible drive arrangements may be employed as desired.

As shown, the cartridge 10 is removably mounted in operative relation to an incremental rotary printer of the type having a rotatable print wheel 13 with a plurality of character pads 14 each mounted on the outer end of a different one of a plurality of radial spokes 15. Spokes 15 are secured to a central hub 16 which is rotated by a drive motor (not shown). The cartridge houses an endless inked ribbon 13 which is threaded through a pair of conventional ribbon guide members 20, 21 each carried by platform 11. Ribbon guides 20, 21 position ribbon 18 in a print station defined by an aperture 22 in a plate 23 so that a character pad 14 presses ribbon 18 against the surface of a sheet of paper 24, or other suitable print receptor, resting on the surface of a platen 25 whenever a print hammer 26 is actuated.

Ribbon 18 is also maintained in contact with the outer surface of a conventional guide arm 27 which is pivotally mounted on platform 11 for motion in a plane substantially parallel with the axis of platen 25. A spring 28 secured between guide arm 27 and a post 29 fixed to platform 11 biases arm 27 outwardly of the ribbon loop. Guide arm 27 provides a yieldable ribbon surface guide in the event the ribbon 18 is accelerated at unusually high rates.

Figure 2:
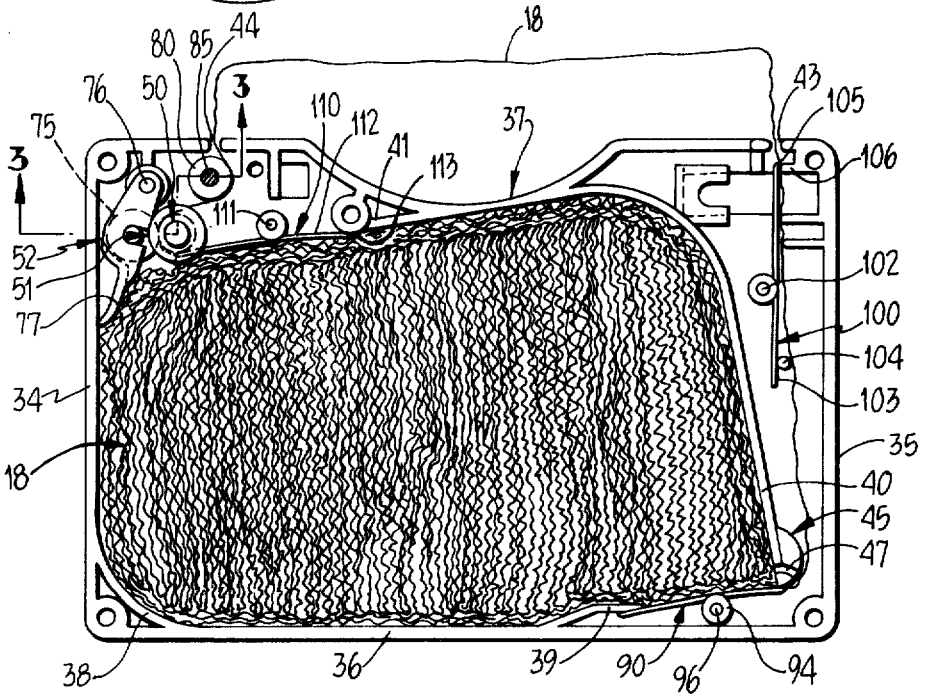
FIG. 2 is a top plan view of the embodiment of FIG. 1 with the cover removed.
Figure 5:
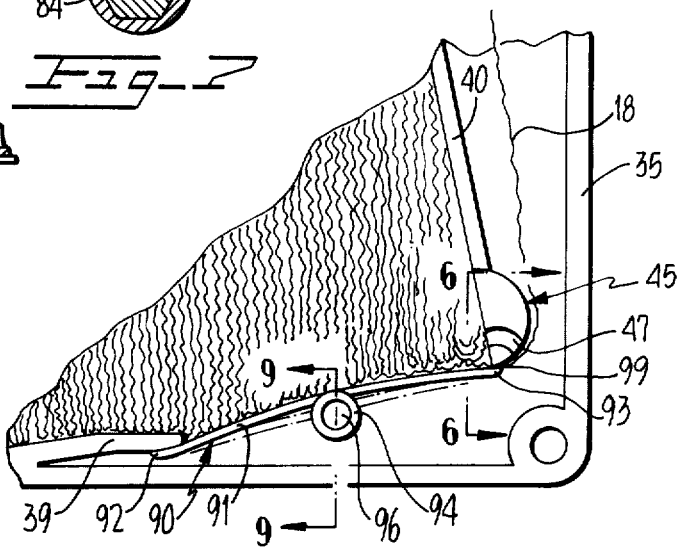
FIG. 5 is an enlarged detailed view showing the boundary wall exit portion and tensioning blade.
Figure 6:
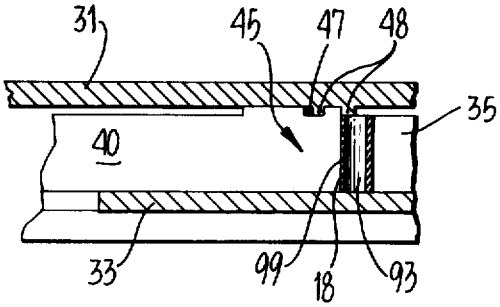
FIG. 6 is a sectional view taken along lines 6—6 of FIG. 5 showing the cartridge cover in place.

With reference to FIGS. 1 and 2, cartridge 10 includes a cover member 31 and a base member generally designated by reference numeral 32, both members being preferably molded from a plastic material. Base member 32 has a bottom wall 33 and an integral upstanding peripheral wall portion defining a pair of side walls 34,35, a front wall 36 and a rear wall 37. Formed interiorly of walls 34–37, are inner wall portions 38–41 having substantially the same height as wall portions 24–37 and partially defining a ribbon chamber generally designated by reference numeral 42. Formed in rear wall portion 37 are an exit slot 43 and an entrance slot 44 for permitting egress and ingress, respectively, of endless ribbon 18. As best shown in FIGS. 5 and 6, inner boundary wall portion 40 has an end portion 45 of slightly greater height than the remainder of wall portion 40 and enlarged thickness, with the top surface thereof being provided with a groove or channel 47 the bottom of which is substantially coplanar with the top surface of wall portion 40. A downwardly depending arcuate boss 48 formed on the inner surface of cover 31 is received in channel 47 when cartridge 10 is assembled to limit motion of ribbon 18 in the vertical direction shown in FIG. 6. This arrangement prevents ribbon 18 from riding up and over wall portion 40 or an end portion 93 of a spring blade 91 described below.

Figure 3:
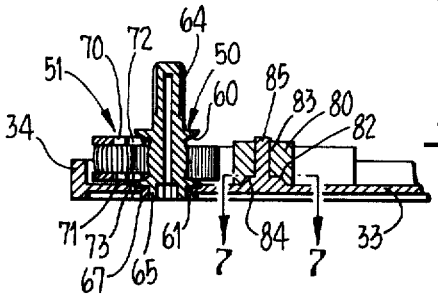
FIG. 3 is a sectional view taken along lines 3—3 of FIG. 2.
Figure 4:
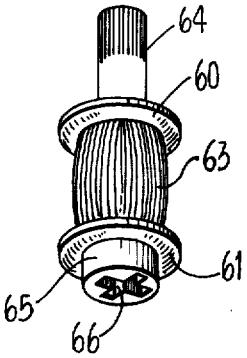
FIG. 4 is a bottom perspective view of the ribbon capstan of the preferred embodiment.

Adjacent entrance slot 44 of cartridge 10 is a ribbon translating mechanism shown in section in FIG. 3. The ribbon translating mechanism includes a ribbon capstan 50, a pinch roller 51 and a biasing member 52. As best shown in FIGS. 3 and 4, ribbon capstan 50 is a unitary member having a pair of axially spaced flanges 60, 61 and a central body portion 62 located therebetween. Body portion 62 has a grooved or serrated convex or barrel-shaped surface 63 for gripping ribbon 18. Projecting upwardly from the upper surface of flange 60 is a stem portion 64 having a substantially cylindrical grooved outer surface of sufficient length to protrude above the top surface of cover member 31 of cartridge 10 for permitting manual rotation of ribbon capstan 47. Extending below flange 61 is a substantially cylindrical base portion 65 having a decussate aperture 66 adapted to receive a mating drive member (not shown) in order to effect rotation of capstan 47 in the counter clockwise direction as viewed in FIG. 2. As best shown in FIG. 3, base portion 65 is rotatably received in a reinforced aperture 67 formed in bottom wall 33 of the cartridge base member 32.

Pinch roller 51 is a unitary member having a grooved or serrated convex or barrel-shaped surface 68 for gripping ribbon 18, and a pair of oppositely extending axle stubs 70, 71, which are received in upper and lower slots 72, 73 in biasing member 52. Biasing member 52 has an end portion 75 pivotally mounted on a pivot post 76 secured to the cartridge housing and a resilient arm 77 which is normally in flexing contact against the inner surface of adjacent side wall 34 of the cartridge housing in order to provide a yieldable biasing force for pinch roller 51 urging this latter element into engagement with drive surface 63 of ribbon capstan 50.

Figure 7:
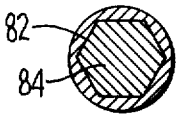
FIG. 7 is a sectional view taken along lines 7—7 of FIG. 3.

Mounted adjacent ribbon capstan 50 and cartridge entrance slot 44 is a guide 80, which is preferably stationary, about which the re-entrant portion of ribbon 18 is passed. With reference to FIG. 3, in the preferred embodiment guide 80 is provided with a recessed lower bottom surface 82 and an axial bore 83 into which an upstanding boss portion 84 terminating in a spindle 85 is received. As best shown in FIG. 7 recessed bottom surface 82 and boss portion 84 are both hexagonally shaped in cross section so that guide 80 is restrained against rotation as ribbon 18 is transported past this member.

As will be evident to those skilled in the art, the wrap angle required for ribbon 18 at ribbon capstan 50 and guide 80 is relatively small, being on the order of less than 90°.

Figure 9:
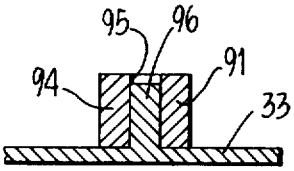
FIG. 9 is a sectional view taken along lines 9—9 of FIG. 5.
Figure 8:
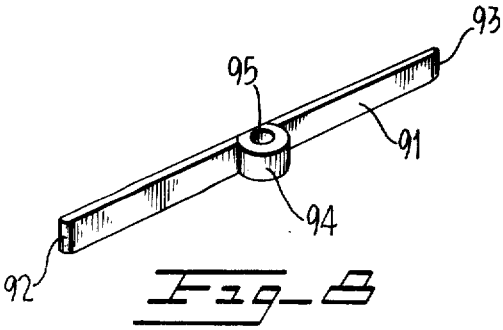
FIG. 8 is a perspective view of a spring member.

As noted above, boundary wall portions 38–41 partially define ribbon chamber 42 for ribbon 18. The remainder of chamber 42 is defined by arm 77 is biasing member 52, surfaces 63, 68 of capstan 50 and pinch roller 51 respectively, and a pair of spring-like members 90, 110 each of substantially the same configuration. With reference to FIGS. 5, 8 and 9, spring member 90 is provided with a blade portion 91 having a pair of chamfered end portions 92, 93, and a hub portion 94 located at approximately the midpoint of blade 91 and offset from the longitudinal axis thereof. Hub portion 94 is provided with a through bore 95 for receiving a substantially cylindrical upstanding spindle 96 integrally molded in bottom wall 33. Spindle 96 is so positioned on bottom 33 that blade 91 is flexed slightly in a concave downward direction as viewed in FIG. 5 when spring member 90 is installed on boss 96. To illustrate this flexing, FIG. 5 shows blade 90 in solid lines in the actual flexed position and in a relaxed position in phantom. It should be noted that the actual amount of flexing of blade 90 is much less than that depicted in FIG. 5, which exaggerates the amount of flexing for illustrative purposes only.

When mounted, end 92 of blade 91 bears against the end portion of wall portion 39 to block egress of ribbon 18 at the junction of these two elements. End 93 of blade 91 forms with edge 99 of end portion 45 of wall portion 40 an exit permitting egress of ribbon 18 from the ribbon chamber. End portion 93 of blade 91 also provides a drag force on exiting ribbon 18 for tensioning this element.

With reference to FIG. 2, a second spring member 100 is mounted on a spindle boss in a flexed attitude, with a first end 103 bearing against an upstanding boss 104 projecting upwardly from base 33, and a second end 105 bearing against a lateral projection 106 formed in base 33 adjacent exit slot 43 with ribbon 18 between end portion 105 and the edge of projection 106. Second spring member 100 provides a drag force on ribbon 18 and also provides a safety feature which prevents a doubly folded or kinked portion of ribbon 18 which may have previously transited past edge 99 from traveling to the outside of the cartridge.

Figure 10:
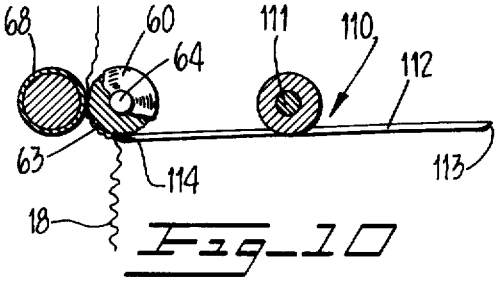
FIG. 10 is an enlarged detailed view partially broken away showing the ribbon transport and anti-fouling mechanism.

Spring member 110 is mounted on a spindle boss 111 with a first end 113 of blade 112 bearing against wall portion 41 and a second end 114 bearing against surface 63 of capstan 50. As best shown in FIG. 10, chamfered end 114 functions as a doctor blade to strip ribbon 18 from surface 63 of capstan 50 after the ribbon 18 transits past the ribbon gripping region between capstan 50 and pinch roller 51.

Spring members 90, 100, 110 are preferably molded from a suitable plastic material such as acetal. Alternatively, these elements may be fabricated from a metallic spring material, preferably by metal stamping.

In operation, cartridge 10 is first mounted onto platform 11 and ribbon 18 is threaded through guides 20, 21 forming a loop externally of cartridge 10. Next, shaft portion 64 is manipulated to remove any slack from the ribbon loop. Drive mechanism 12 is then actuated to rotate ribbon capstan 50. As ribbon capstan 50 and pinch roller 51 rotate, ribbon 18 is withdrawn from ribbon chamber 42 past edge 99 and through exit slot 43 to the exterior of cartridge 10, is translated past print station 22 and is fed back into the ribbon chamber 42 via entrance slot 44, past guide 80, and the capstan pinch roller assembly. Spring members 90, 100 provide a drag force on the ribbon of relatively constant magnitude and also serve to prevent exit of multiple layers of ribbon 18 from the cartridge 10. The interlocking fit between downwardly depending boss 48 extending downwardly from the underside of cover 31 and channel 47 in the upper surface of enlarged end portion 45 of inner boundary wall portion 40 restrains ribbon 18 from migration upwardly along edge 99 in order to maintain exiting ribbon 18 in the exit portion defined by edge 99 and end 93 of spring blade 99. At the inlet side of the cartridge 10, end portion 114 of spring member 110 continually strips away entering ribbon from the wall boundaries. With continued withdrawal of ribbon 18, the reentrant ribbon migrates randomly across ribbon chamber 42 and eventually arrives at edge 99.

During the ribbon transport operation, any sudden acceleration of ribbon 18 is compensated by guide arm 27 which yields inwardly in response to sudden deceleration.

As will now be evident, the above described invention provides an endless inked ribbon cartridge which is inexpensive to fabricate, which provides relatively constant ribbon tension, and which prevents fouling of the ribbon within the cartridge.

While the above provides a full and complete disclosure of the preferred embodiment of the invention, various modifications, alternate constructions and equivalents may be employed without departing from the spirit and scope of the invention. Therefore, the above should not be construed as limiting the invention, which is defined by the appended claims.

What is claimed is:

1. A cartridge for supplying an endless inked ribbon to a printing station external to said cartridge in an associated printing apparatus, said cartridge comprising:

a housing including a cover member having an inner surface with a downwardly depending arcuate projection and a main body portion having a ribbon entrance slot, a ribbon exit slot and interior boundary walls partially defining an interior ribbon chamber for said endless inked ribbon, said chamber having an exit portion and an entrance portion, the portion of said interior boundary wall partially defining said exit portion including a relieved channel extending transversely along the top surface thereof, said arcuate projection being received within said relieved channel and adjacent said exit portion when said cover member and said main body portion are assembled;

an endless inked ribbon received within said ribbon chamber and arranged in random folds, said ribbon having an upper edge facing said inner surface of said cover member a portion of said ribbon extending from said exit portion through said exit slot and said entrance slot to said entrance portion to form a closed ribbon path;

ribbon transport means for providing a force for translating said ribbon from said exit portion to said entrance portion via said exit slot and said entrance slot, said ribbon transport means including a capstan member rotatably mounted in said housing, said capstan member having a pair of axially spaced flanges and a curved surface portion therebetween; said surface portion having a serrated wall surface;

means adjacent said exit portion for providing a substantially constant drag force on said ribbon; and means adjacent said entrance portion and said ribbon transport means for deflecting entering ribbon into said chamber, said drag force means and said deflecting means defining the remainder of said interior ribbon chamber, said drag force means and said deflecting means each comprising a hub portion and a resilient blade portion secured to said hub portion, said blade portion being mounted in a flexed position, one end of said blade portion of said deflecting means being arranged in surface contact with said surface portion of said capstan member so that entering ribbon is deflected thereby, one end of said blade portion of said drag force means being arranged to bias said ribbon against said exit portion of said interior boundary wall, said arcuate projection having a portion thereof extending along said inner surface beyond said relieved channel and adapted to contact said upper edge of said ribbon for preventing migration of said ribbon from said exit portion in a direction transverse to said ribbon path.

2. The combination of claim 1 further including second means mounted adjacent said exit slot for providing an additional substantially constant drag force to said ribbon, said second means comprising a hub portion and a resilient blade portion secured to said hub portion, said blade portion being mounted in a flexed position with one end thereof being arranged to bias said ribbon against a wall portion of said exit slot.

3. The combination of claim 1 wherein said ribbon transport means further includes a pinch roller rotatably mounted in said housing and having a curved intermediate serrated surface portion and a pair of oppositely extending stub axles; and a bias member pivotally mounted in said housing and having a pair of spaced slots for embracing said stub axles and a resilient arm engageable with the inner surface of an adjacent side wall of said cartridge for biasing said serrated surface portion of said pinch roller towards said serrated wall surface of said capstan member so that said ribbon is grasped therebetween.

4. The combination of claim 3 further including a curved ribbon guide member positioned adjacent said entrance slot.

5. The combination of claim 1 wherein said ribbon transport means includes a central shaft member protruding exteriorly of said cartridge housing for enabling manual rotation thereof in order to provide initial tension to said ribbon.

6. In combination with a printing device having a pair of ribbon guides defining a printing station, a cartridge for supplying a translatable endless inked ribbon to said printing station, said cartridge comprising:

a housing including a cover member having an inner surface with a downwardly depending arcuate projection and a main body portion having a ribbon entrance slot, a ribbon exit slot and interior boundary walls partially defining an interior ribbon chamber for said endless inked ribbon, said chamber having an exit portion and an entrance portion, the portion of said interior boundary walls adajacent said exit portion including a relieved channel extending transversely along the top surface thereof, said arcuate projection being received within said relieved channel adjacent said exit portion when said cover member and said main body portion are assembled;

an endless inked ribbon received within said ribbon chamber and arranged in random folds, said ribbon having an upper edge facing said inner surface of said cover member a portion of said ribbon extending from said exit portion through said exit slot and said entrance slot to said entrance portion to form a closed ribbon path;

ribbon transport means for providing a force for translating said ribbon from said exit portion to said entrance portion via said exit slot and said entrance slot, said ribbon transport means including a capstan member rotatably mounted in said housing, said capstan member having a pair of axially spaced flanges and a curved surface portion therebetween, said surface portion having a serrated wall surface;

means adjacent said exit portion for providing a substantially constant drag force on said ribbon, and means adjacent said entrance portion and said ribbon transport means for deflecting entering ribbon into said chamber, said drag force means and said deflecting means defining the remainder of said interior ribbon chamber, said drag force means and said deflecting means each comprising a hub portion and a resilient blade portion secured to said hub portion, said blade portion being mounted in a flexed position, one end of said blade portion of said deflecting means being arranged in surface contact with said surface portion of said capstan member so that entering ribbon is deflected thereby, one end of said blade portion of said drag force means being arranged to bias said ribbon against said exit portion of said interior boundary walls;

said arcuate projection having a portion thereof extending along said inner surface beyond said relieved channel and adapted to contact said upper edge of said ribbon for preventing migration of said ribbon from said exit portion in a direction transverse to said ribbon path.

7. The combination of claim 6 further including second means mounted adjacent said exit slot for providing an additional substantially constant drag force to said ribbon, said second means comprising a hub portion and a resilient blade portion secured to said hub portion, said blade portion being mounted in a flexed position with one end thereof being mounted in a flexed position with one end thereof being arranged to bias said ribbon against a wall portion of said exit slot.

8. The combination of claim 6 wherein said ribbon transport means further includes a pinch roller rotatably mounted in said housing and having a curved intermediate serrated surface portion and a pair of oppositely extending stub axles; and a bias member pivotally mounted in said housing and having a pair of spaced slots for embracing said stub axles and a resilient arm engageable with the inner surface of an adjacent side wall of said cartridge for biasing said serrated surface portion of said pinch roller toward said serrated wall surface of said capstan member so that said ribbon is grasped therebetween.

9. The combination of claim 8 further including a curved ribbon guide member positioned adjacent said entrance slot.

10. The combination of claim 6 wherein said ribbon transport means includes a central shaft member protruding exteriorly of said cartridge housing for enabling manual rotation thereof in order to provide initial tension to said ribbon.

11. The combination of claim 6 further including a guide arm pivotally mounted on said printing device adjacent one of said pair of ribbon guides, and means for biasing said guide arm in a direction outwardly of said printing station, said guide arm and said biasing means providing a tension relief for said ribbon when said ribbon is subjected to sudden acceleration.

* * * * *